US010686274B2

(12) United States Patent
Forell et al.

(10) Patent No.: US 10,686,274 B2
(45) Date of Patent: Jun. 16, 2020

(54) PLUG CONNECTOR HAVING A CONTACT HOUSING, OUTER HOUSING AND SECURING ELEMENT

(71) Applicant: TE Connectivity Germany GmbH, Bensheim (DE)

(72) Inventors: Richard Forell, Lorsch (DE); Andreas Leonhard, Darmstadt (DE)

(73) Assignee: TE Connectivity Germany GmbH, Bensheim (DE)

( * ) Notice: Subject to any disclaimer, the term of this patent is extended or adjusted under 35 U.S.C. 154(b) by 0 days.

(21) Appl. No.: 16/299,620

(22) Filed: Mar. 12, 2019

(65) Prior Publication Data

US 2019/0214764 A1 Jul. 11, 2019

Related U.S. Application Data

(63) Continuation of application No. PCT/EP2017/072961, filed on Sep. 13, 2017.

(30) Foreign Application Priority Data

Sep. 13, 2017 (DE) ..... 10 2016 217 456

(51) Int. Cl.

| | |
|---|---|
| ***H01R 33/00*** | (2006.01) |
| ***H01R 13/436*** | (2006.01) |
| ***H01R 13/506*** | (2006.01) |
| ***H01R 13/52*** | (2006.01) |
| ***H01R 13/629*** | (2006.01) |

(52) U.S. Cl.

CPC ..... *H01R 13/4361* (2013.01); *H01R 13/506* (2013.01); *H01R 13/5202* (2013.01); *H01R 13/629* (2013.01)

(58) Field of Classification Search

CPC ..... H01R 13/4361; H01R 13/506; H01R 13/5202; H01R 13/629

USPC ..... 439/660, 701

See application file for complete search history.

(56) References Cited

U.S. PATENT DOCUMENTS 5,941,737 A 8/1999 Sakai et al.
6,383,020 B2 5/2002 Taguchi et al.
(Continued)

FOREIGN PATENT DOCUMENTS

CN 1211836 A 3/1999
CN 102754288 A 10/2012
(Continued)

OTHER PUBLICATIONS

German Office Action, dated May 4, 2017, 6 pages.
(Continued)

*Primary Examiner* — Khiem M Nguyen
(74) *Attorney, Agent, or Firm* — Barley Snyder

(57) ABSTRACT

An electrical plug connector adapted to be assembled with a mating connector in an insertion direction comprises an outer housing, a contact housing adapted to be secured in the outer housing and having a contact receptacle receiving an electrical contact, a shaft extending through the outer housing and the contact housing, and a securing element adapted to positively lock the outer housing to the contact housing. The securing element is inserted in the shaft in a securing direction extending transversely relative to the insertion direction.

16 Claims, 4 Drawing Sheets

(56) References Cited

U.S. PATENT DOCUMENTS

| | | | | |
|---|---|---|---|---|
| 8,366,473 | B2 * | 2/2013 | Kataoka | H01R 13/506 439/350 |
| 9,484,660 | B2 * | 11/2016 | Shuey | H01R 13/501 |
| 9,640,905 | B2 * | 5/2017 | Suzuki | H01R 13/6271 |
| 2001/0016457 | A1 | 8/2001 | Taguchi et al. | |
| 2002/0127913 | A1 | 9/2002 | Ichio | |
| 2006/0264081 | A1 | 11/2006 | Osada et al. | |

FOREIGN PATENT DOCUMENTS

| | | | |
|---|---|---|---|
| DE | 199 41 328 | C2 | 12/2001 |
| DE | 10 2007 005 349 | A1 | 8/2008 |
| DE | 10 2007 014 065 | A1 | 10/2008 |
| DE | 10 2007 037 728 | B3 | 3/2009 |
| EP | 0903814 | A1 | 3/1999 |
| EP | 1081802 | A1 | 3/2001 |
| EP | 1109263 | A2 | 6/2001 |
| EP | 1109263 | A3 | 3/2003 |
| EP | 2639839 | A1 | 9/2013 |
| EP | 2639893 | A1 | 9/2013 |
| JP | 2001237019 | A | 8/2001 |
| JP | 2002203632 | A | 7/2002 |
| WO | 2011069611 | A1 | 6/2011 |

OTHER PUBLICATIONS

PCT Notification, International Search Report and Written Opinion of the International Searching Authority, Intl Appl No. PCT/EP2017/072961, dated Oct. 24, 2017, 16 pages.

Abstract of DE 10 2007 014 065, dated Oct. 2, 2008, 1 page.

Abstract of DE 10 2007 037 728, dated Mar. 5, 2009, 1 page.

Corresponding Abstract of EP1953878, related to DE102007005349, dated Aug. 7, 2008, 2 pages.

Chinese First Office Action with English translation, Chinese Patent Application No. 201780055557.7, dated Nov. 29, 2019, 20 pages.

Abstract of CN 1211836 A, dated Mar. 24, 1999, 2 pages.

Notice of Reasons for Refusal, dated Mar. 31, 2020, 8 pages.

Abstract of JP2002203632, dated Jul. 19, 2002, 1 page.

* cited by examiner

PLUG CONNECTOR HAVING A CONTACT HOUSING, OUTER HOUSING AND SECURING ELEMENT

CROSS-REFERENCE TO RELATED APPLICATIONS

This application is a continuation of PCT International Application No. PCT/EP2017/072961 filed on Sep. 13, 2017, which claims priority under 35 U.S.C. § 119 to German Patent Application No. DE102016217456.8 filed on Sep. 13, 2016.

FIELD OF THE INVENTION

The present invention relates to an electrical plug connector which can be assembled with a mating connector in an insertion direction which has at least one contact receptacle for receiving at least one electrical contact.

BACKGROUND

In a plug connector, an outer housing and a contact housing which is separate therefrom allows for different connector faces to be fitted for different plug connections on the same outer housing. Particularly in the case of small or miniaturized plug connectors, however, where the structural length is less than 3 cm and the line cross-section is only 0.1 $mm^2$, the connection between the outer housing and the contact housing has an inadequate tensile strength because of the small structural size of the plug connector. Consequently, in some cases, the contact housing remains with the mating connector and is released from the outer housing during an attempt to release the connection between the connector and the mating connector.

SUMMARY

An electrical plug connector adapted to be assembled with a mating connector in an insertion direction comprises an outer housing, a contact housing adapted to be secured in the outer housing and having a contact receptacle receiving an electrical contact, a shaft extending through the outer housing and the contact housing, and a securing element adapted to positively lock the outer housing to the contact housing. The securing element is inserted in the shaft in a securing direction extending transversely relative to the insertion direction.

BRIEF DESCRIPTION OF THE DRAWINGS

The invention will now be described by way of example with reference to the accompanying Figures, of which.

DETAILED DESCRIPTION OF THE EMBODIMENT(S)

Figure 1:
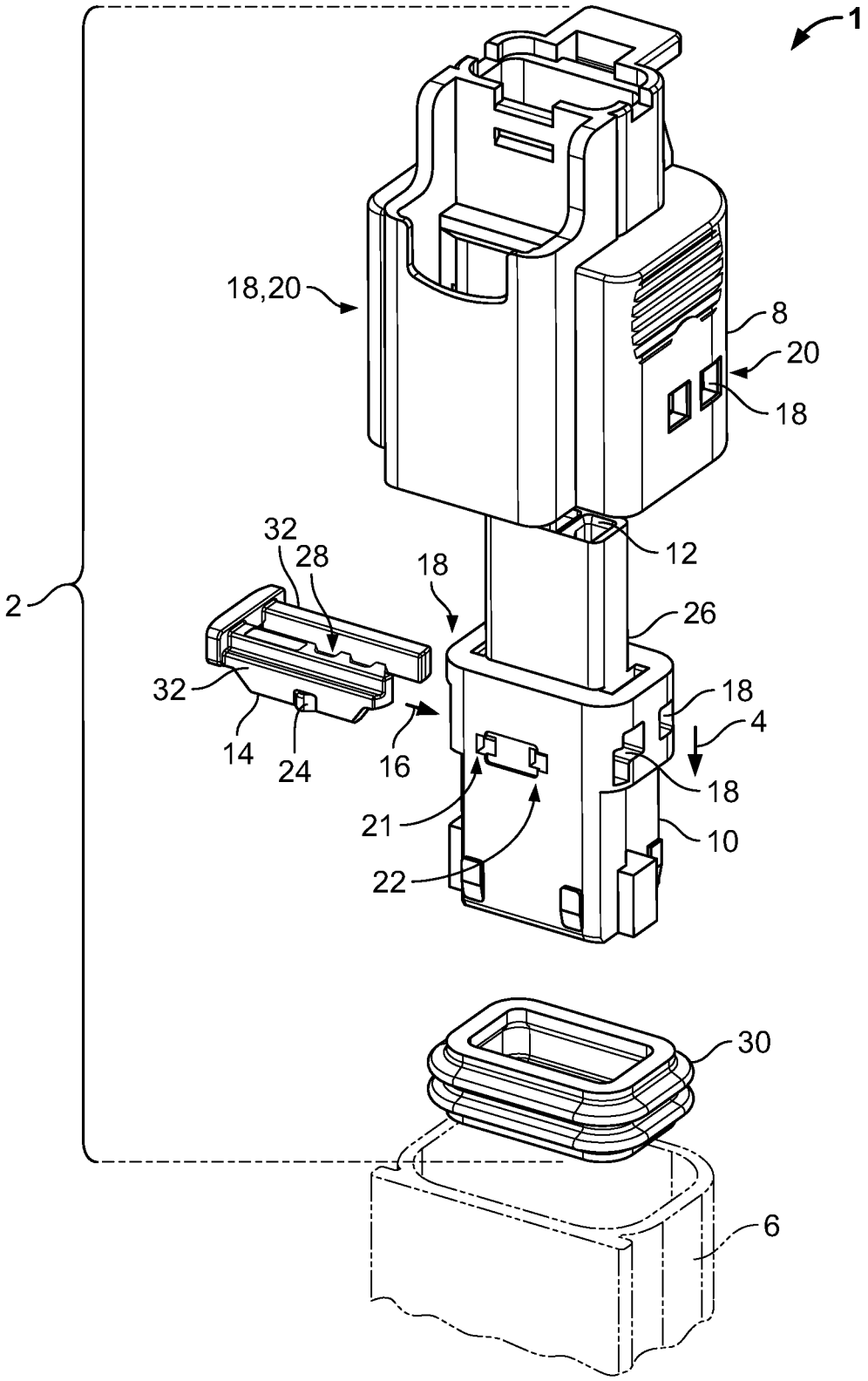
FIG. 1 is a perspective exploded view of an electrical plug connector according to an embodiment.

Embodiments of the present disclosure will be described hereinafter in detail with reference to the attached drawings, wherein like reference numerals refer to like elements. The present invention may, however, be embodied in many different forms and should not be construed as being limited to the embodiment set forth herein; rather, these embodiments are provided so that the present disclosure will convey the concept of the invention to those skilled in the art.

Figure 2:
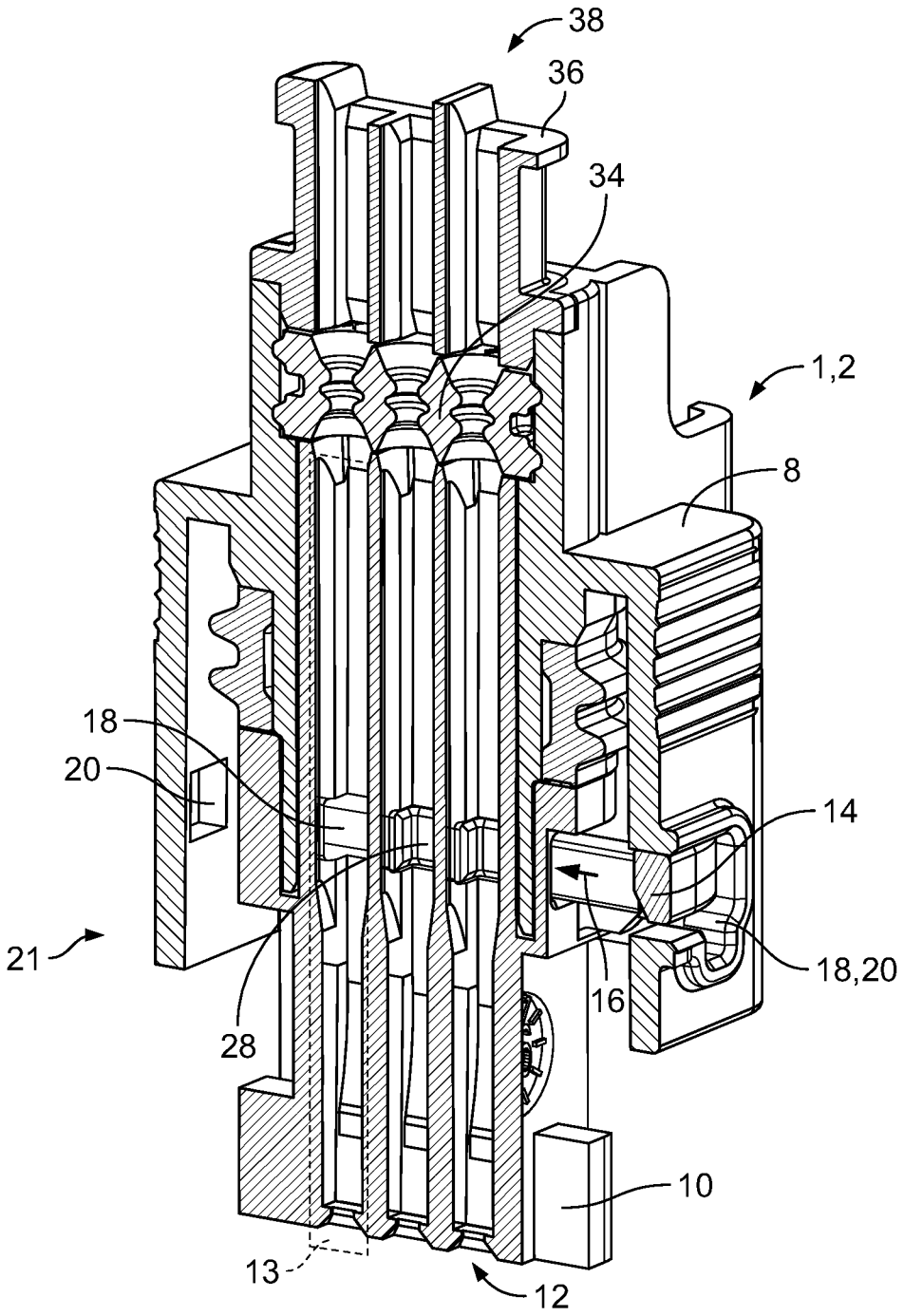
FIG. 2 is a perspective cross-section of the electrical plug connector.
Figure 3:
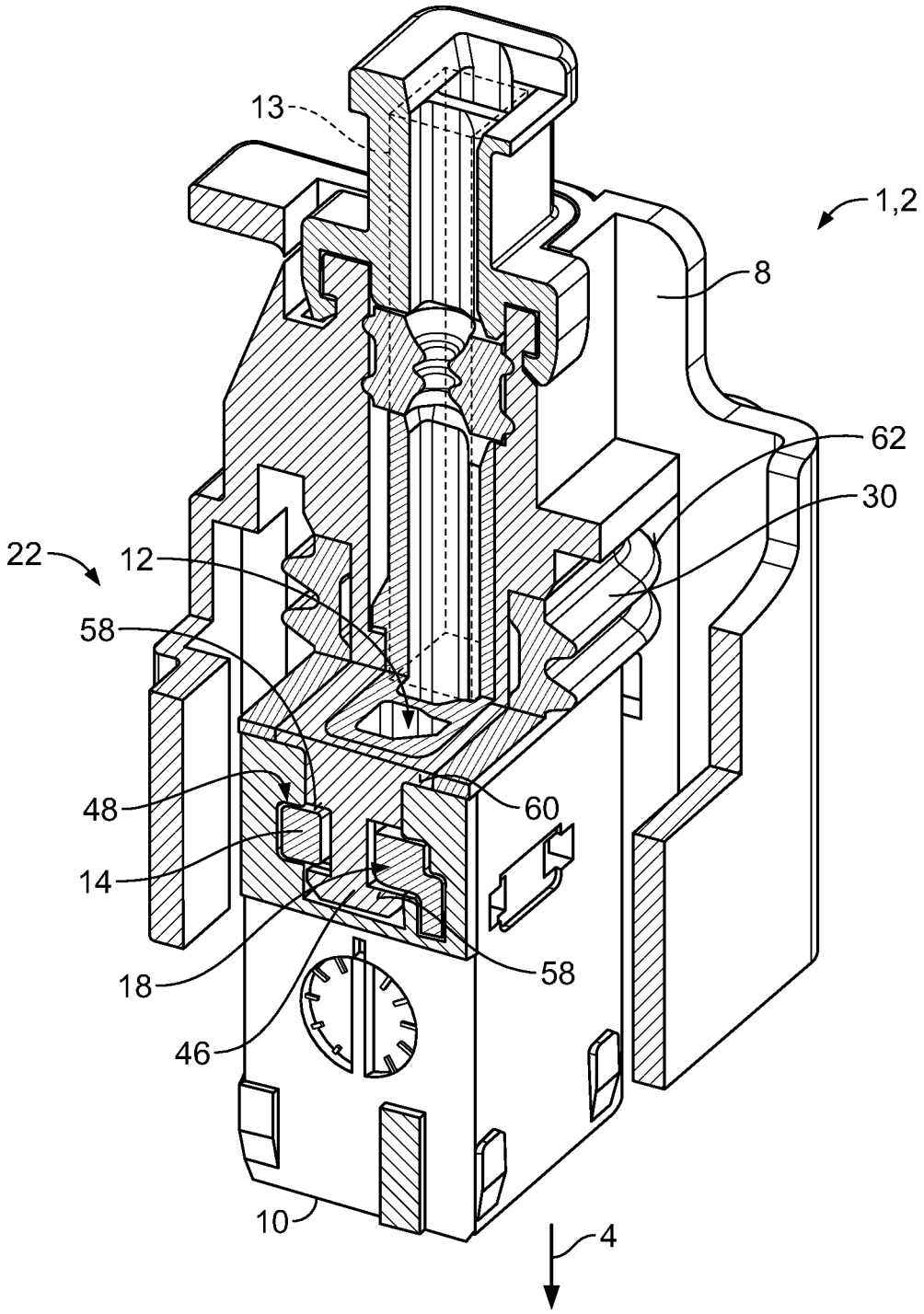
FIG. 3 is a perspective cross-section of the electrical plug connector.

An arrangement 1 of a plug connector 2 according to an embodiment is shown in FIGS. 1-3. The plug connector 2 is assembled with a mating connector 6 in an insertion direction 4 in order to produce an electrical connection.

The plug connector 2, as shown in FIGS. 1-3, comprises an outer housing 8 in which a contact housing 10 is received. The contact housing 10 has a contact receptacle 12 in which an electrical contact 13, shown in FIGS. 2 and 3, can be introduced or is inserted. In an embodiment, the plug connector 2 is a miniature connector having a total length of less than 30 mm and the contacts 13 used therein are suitable for very small line cross-sections down to 0.1 $mm^2$.

The contact housing 10 is inserted into the outer housing 8, and the outer housing 8 and the contact housing 10 are joined together parallel with the insertion direction 4, as shown in FIGS. 2 and 3. The plug connector 2 includes a securing element 14, as shown in FIGS. 1-3, holding the outer housing 8 and the contact housing 10 together. The securing element 14 is introduced into a shaft 18 in a securing direction 16; the shaft 18 extends both through the outer housing 8 and through the contact housing 10. In an embodiment, the shaft 18 extends through the contact receptacle 12. The securing direction 16 extends transverse to the insertion direction 4. The shaft 18 is open at a pair of opposite ends 20 thereof located in the outer housing 8.

The securing element 14 can be engaged in two catch positions 21, 22, shown in FIGS. 1-3, which are spaced apart from each other in the securing direction 16. In an embodiment, a catch projection 24 on the securing element 14 engages a plurality of catch receptacles 26 corresponding to the catch projection 24 and defining the catch positions 21, 22. In another embodiment, two catch projections 24 which are spaced apart from each other in the securing direction 16 and only one catch receptacle 26 may be used. In an embodiment, the catch projection 24 may also be arranged on the outer housing 8 or contact housing 10 and the catch receptacle 26 may be arranged on the securing element 14.

The first catch position 21 is located in front of the second catch position 22 in the securing direction 16, as shown in FIG. 1. The securing element 14, as shown in FIGS. 1 and 2, has a contact recess 28 aligned in the first catch position 21 with the contact receptacle 12. In the first catch position 21, the contacts 13 can be inserted into the contact receptacle 12 and the outer housing 8 and the contact housing 10 are already connected to each other by the securing element 14.

In the second catch position 22, the securing element 14 is completely pushed into the shaft 18. The outer housing 8 and the contact housing 10 are connected to each other. The contact 13 is also secured by the securing element 14 in the contact receptacle 12; the securing element 14 thereby acts as a contact securing member. In the second catch position 22, the securing element 14 at least partially blocks, closes, and/or passes through the contact receptacle 12.

In both catch positions 21, 22, the outer housing 8 and the contact housing 10 are connected to each other in a positive-locking manner by the securing element 14. In the first catch position 21, the contact receptacle 12 can be released from the securing element 14. It is consequently possible to insert the contact 13 into the contact receptacle 12 while the outer housing 8 and the contact housing 10 are already secured by the securing element 14.

As shown in FIG. 1, the plug connector 2 has a seal 30. In an embodiment, the seal 30 is a radial seal.

The securing element 14, as shown in FIG. 1, is substantially U-shaped and has a pair of legs 32. A respective shaft 18 is associated with each of the pair of legs 32. The contact recess 28 may be arranged on only one of the legs 32. The catch projection 24 may be arranged in a similar manner.

The plug connector 2, as shown in FIG. 2, has a mat seal 34 and a sealing holder 36 at a cable-side end 38 of the plug connector 2. The sealing holder 36 is engaged with the outer housing 8. The mat seal 34 is located, in a slightly compressed state, between the sealing holder 36 and the outer housing 8 and/or the contact housing 10.

The securing element 14 is shown in the first catch position 21 in FIG. 2. As shown in FIG. 2, the contact receptacle 12, and all three contact receptacles 12 in the shown embodiment, is/are aligned with the contact recesses 28 of the securing element 14. Starting from the first catch position 21 shown in FIG. 2, the securing element 14 is moved in the securing direction 16 into the second catch position 22, in which the contact receptacles 12 are partially closed by the securing element 14 and the contacts 13 inserted therein are secured in a positive-locking manner.

Figure 4:
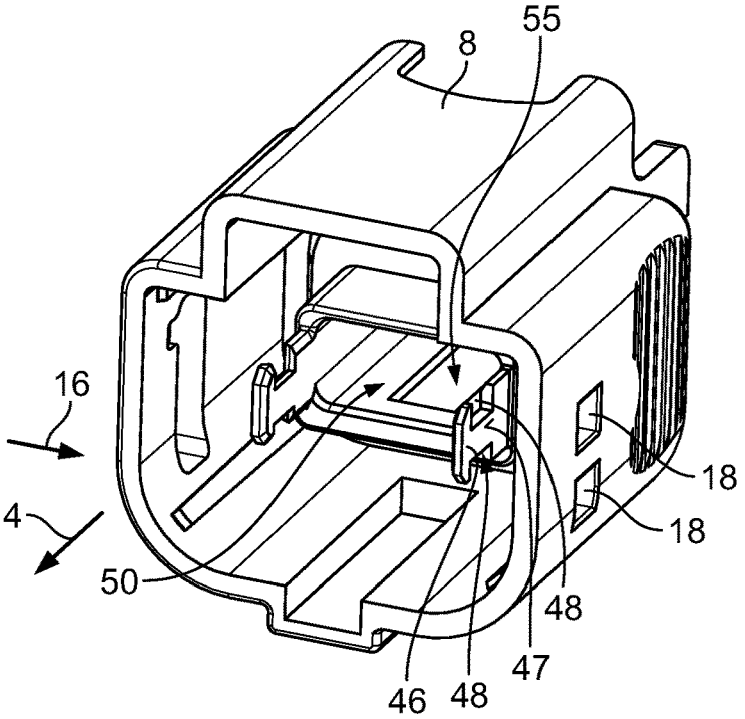
FIG. 4 is a perspective view of an outer housing of the electrical plug connector.

In order to connect the outer housing 8 and the contact housing 10 to each other with the securing element 14, the outer housing 8, as shown in FIG. 4, has a securing tab 46 extending in the insertion direction 4. The securing tab 46 is a monolithic component of the injection-moulded outer housing 8. The securing tab 46 has at least one, for example, polygonal or rectangular recess 48 aligned with the shaft 18 in the securing direction 16; the securing tab 46 forms at least a portion of the shaft 18. As shown in FIG. 4, a plurality of recesses 48, for example, two recesses 48, which are aligned with a plurality of shafts 18 may be provided at the securing tab 46. In the shown embodiment, the securing tabs 46 are flat members, the flat sides 49 of which extend transversely relative to the securing direction 16.

The outer housing 8 may have two or more securing tabs 46, in particular extending parallel with each other, as shown in the embodiment of FIG. 4. A receptacle 50 is disposed between the securing tabs 46. The contact housing 10 can be at least partially introduced into the receptacle 50. The securing tabs 46 project at both sides of the receptacle 50 in an insertion direction 4 and are consequently used as guides for the contact housing 10.

Figure 5:
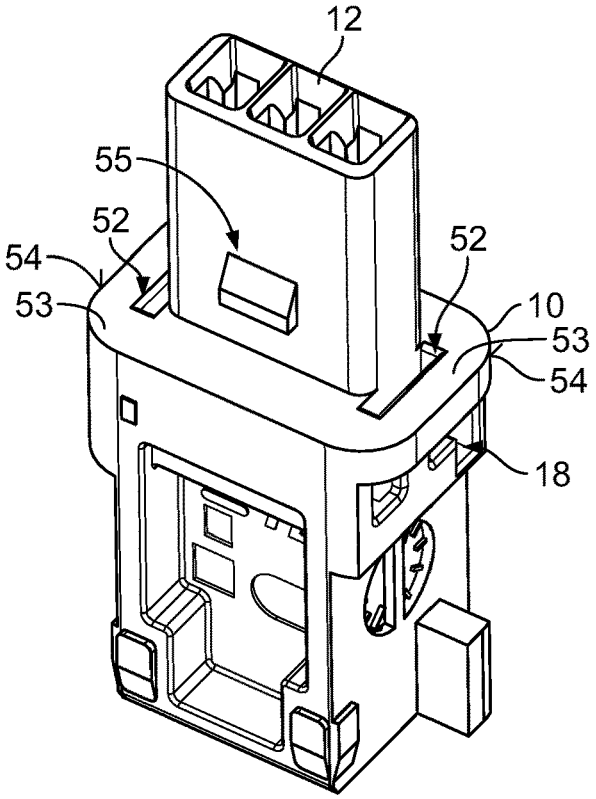
FIG. 5 is a perspective view of a contact housing of the electrical plug connector.

In order to receive the securing tabs 46, the contact housing 10 has a securing shaft 52, as shown in FIG. 5. The securing shaft 52 traverses the shaft 18 so that the two shafts 18, 52 extend partially through each other. The contact receptacle 12 is located at least partially between two shafts 52, into which the two securing tabs 46 of the outer housing 8 of the embodiment illustrated in FIG. 4 can be introduced. In the shown embodiment, the two securing tabs 46 are parallel and disposed one behind the other in the securing direction 16 and the two shafts 52 are located one behind the other in the securing direction 16. The number of securing tabs 46 corresponds to the number of shafts 52. The securing shaft 52 can be constructed in an outer wall 53. The outer wall 53 forms an outer face 54 of the contact housing 10 and borders on a contact receptacle 12 at the inner side. In another embodiment, the securing tab 46 is disposed on the contact housing 10 and the securing shaft 52 is disposed in the outer housing 8.

As shown in FIGS. 4 and 5, an additional catch connection 55 is disposed on the outer housing 8 and the contact housing 12 to further secure the outer housing 8 and contact housing 10.

FIG. 3 shows the plug connector 2 in the completely assembled state in the catch position 22. In the catch position 22, the securing element 14 introduced into the shaft 18 extends through the recesses 48 of the securing tab 46. The recesses 48 define a portion of the shaft 18. If an attempt is made to remove the contact housing 10 from the outer housing 8, the undercut 58 of the securing tab 46 strikes the securing element 14 received in the shaft 18; the securing tab 46 is secured in a positive-locking manner at least in the insertion direction 4. In an embodiment, a movement in a direction opposite to the insertion direction 4 is prevented by a stop arranged at another location. The use of the securing element 14 to connect the outer housing 8 and the contact housing 10 increases the tensile strength of the connection between the outer housing 8 and the contact housing 10 so that the outer housing 8 and the contact housing 10 can no longer be separated from each other when the connection of the plug connector 2 and the mating connector 6 is released.

The seal 30, as shown in FIG. 3, is supported in a sealing manner between the outer housing 8 and the contact housing 10 and seals a separation joint 60 between the outer housing 8 and the contact housing 10. When the plug connector 2 and mating connector 6 are connected to each other, the outer peripheral face 62 of the seal 30 abuts an inner side of the mating connector 6 and consequently also seals the separation joint 60 between the mating connector 6 and the plug connector 2. The securing tab 46 is spaced apart from the seal 30 or the separation joint 60 in the insertion direction 4. The shaft 18 is located at the side of the seal 30 facing the mating connector 6 or of the separation joint 60 with spacing therefrom in the insertion direction 4. When the mating connector 8 and plug connector 2 are assembled, the shaft 18 is covered by the mating connector 8. The seal 30 then prevents moisture and dirt from being introduced into the shaft 18. The securing tab 46 extends in the insertion direction 4 to the other side of the seal 30. The recess 48 may be spaced apart in the insertion direction 4 from the seal 30 or the separation joint 60 and may be located at the side of the securing tab 46 located at the other side of the seal 30 or separation joint 60 when viewed from the contact housing 10 and/or outer housing 8 with the respective securing tab 46.

What is claimed is:

1. An electrical plug connector adapted to be assembled with a mating connector in an insertion direction, comprising:

an outer housing having a securing tab extending in the insertion direction;

a contact housing adapted to be secured in the outer housing and having a contact receptacle receiving an electrical contact, the contact housing having a securing shaft extending in the insertion direction and receiving the securing tab;

a shaft extending through the outer housing and the contact housing; and a securing element adapted to positively lock the outer housing to the contact housing, the securing element is inserted in the shaft in a securing direction extending transversely relative to the insertion direction.

2. The electrical plug connector according to claim 1, wherein the securing element is a contact securing member.

3. The electrical plug connector according to claim 1, wherein the securing tab forms at least a portion of the shaft.

4. The electrical plug connector according to claim 3, wherein the outer housing has at least two securing tabs arranged one behind the other in the securing direction.

5. The electrical plug connector according to claim 3, wherein the securing tab has a recess defining the portion of the shaft when the contact housing is inserted into the outer housing.

6. The electrical plug connector according to claim 5, further comprising a seal between the outer housing and the contact housing, the securing tab extends in the insertion direction to an opposite side of the seal.

7. The electrical plug connector according to claim 6, wherein the recess is spaced apart in the insertion direction from the seal.

8. The electrical plug connector according to claim 7, wherein the recess is disposed at a side of the seal facing the mating connector.

9. The electrical plug connector according to claim 3, wherein the securing shaft is disposed in an outer wall of the contact housing.

10. The electrical plug connector according to claim 4, wherein the contact receptacle is located between the securing tabs.

11. The electrical plug connector according to claim 1, wherein the securing element has a pair of catch positions spaced apart from each other in the securing direction in which the securing element engages.

12. The electrical plug connector according to claim 11, wherein the contact receptacle is at least partially blocked by the securing element in one of the catch positions.

13. The electrical plug connector according to claim 12, wherein, in both of the catch positions, the outer housing and the contact housing are connected to each other in a positive-locking manner by the securing element.

14. The electrical plug connector according to claim 1, wherein the shaft traverses the contact receptacle.

15. The electrical plug connector according to claim 1, wherein the securing element has a pair of parallel legs.

16. The electrical plug connector according to claim 15, wherein the securing tab has a pair of recesses, each of the recesses receiving at least a portion of one of the parallel legs.

* * * * *